United States Patent [19]

Dechelette

[11] 4,220,388

[45] Sep. 2, 1980

[54] ELECTRICAL CONNECTOR AND CONTACT AND HOUSING THEREFOR

[76] Inventor: Helen Dechelette, St. Cloud, France

[21] Appl. No.: 941,509

[22] Filed: Sep. 11, 1978

[30] Foreign Application Priority Data

Sep. 9, 1977 [FR] France ..... 77 27388

[51] Int. Cl.[3] ..... H01R 13/62

[52] U.S. Cl. ..... 339/74 R

[58] Field of Search ..... 339/217 R, 59 R, 59 M, 339/74 R, 258 S, 256 SP

[56] References Cited

U.S. PATENT DOCUMENTS

| | | | |
|---|---|---|---|
| 3,239,918 | 3/1966 | Cobaugh | 339/258 S |
| 3,386,074 | 5/1968 | Woofter | 339/258 S |
| 3,517,370 | 6/1970 | Poingt | 339/59 R |
| 3,550,069 | 12/1970 | Teagno | 339/256 SP |
| 3,729,701 | 4/1973 | Smith | 339/258.5 X |
| 3,976,348 | 8/1976 | Simmons | 339/74 R |
| 4,050,757 | 9/1977 | Glaesel | 339/59 R |

FOREIGN PATENT DOCUMENTS

| | | | |
|---|---|---|---|
| 40757 | 10/1973 | Australia | 339/59 R |

*Primary Examiner*—Joseph H. McGlynn
*Assistant Examiner*—John S. Brown

[57] ABSTRACT

An electrical connector comprises a receptacle contact contained in a one-piece insulating housing and defining a male-contact-receiving passage, the receptacle contact being formed with at least one outwardly directed projection engageable with a surface of the housing on movement of the receptacle contact relative to and within the housing, such engagement effecting an increase in the effective cross-sectional area of the male-contact-receiving passage of the receptacle contact.

15 Claims, 13 Drawing Figures

ELECTRICAL CONNECTOR AND CONTACT AND HOUSING THEREFOR

This invention relates to an electrical connector comprising a receptacle contact contained in a one-piece insulating housing and defining a male-contact-receiving passage.

Such connectors are well known in many forms, the receptacle contact being, for example, for receiving a round pin or a flat tab male contact.

Known connectors generally provide the required connection properties such as contact force between the receptacle contact and a male contact mated therewith, but many suffer from the disadvantage that they require a relatively high insertion force for mating of the male contact with the receptacle contact.

Many connectors are known, which provides a relatively low insertion force, but such connectors generally utilize a housing not of one-piece construction, but having relatively moving parts with relative movement between the parts serving to increase the effective cross-sectional area of the male-contact-receiving passage of the receptacle contact such that the male contact can be inserted into the passage with no appreciable resistance.

However, such known low insertion force connectors are relatively complex in construction and are thus also relatively expensive to manufacture.

According to this invention an electrical connector comprising a receptacle contact contained in a one-piece insulating housing and defining a male-contact-receiving passage, is characterised in that the receptacle contact is formed with at least one outwardly directed projection engageable with a surface of the housing on movement of the receptacle contact relative to and within the housing, such engagement effecting an increase in the effective cross-sectional area of the male-contact-receiving passage of the receptacle contact.

Thus, the connector of this invention has the advantage that it provides for a low insertion force on mating of a male contact with the receptacle contact by the use of a single and thus relatively cheap one-piece housing of the type used with known connectors having a relatively high insertion force.

Preferably the receptacle contact is formed with two outwardly directed projections each engageable with an individually associated surface of the housing on movement of the receptacle contact relative to and within the housing, such engagement serving to urge the two projections away from each other thereby to effect an increase in the effective cross-sectional area of the male-contact-receiving passage of the receptacle contact.

The relative movement between the receptacle contact and the housing can be either along the axis of the male-contact-receiving passage of the receptacle contact, or otherwise about this axis.

Preferably the relative movement between the receptacle contact and the housing is caused by engagement between a male contact being mated with the receptacle contact when the male contact is moved relative to the housing and into the male-contact-receiving passage of the receptacle contact.

The receptacle contact can be formed with a locking projection arranged to engage in a hole or recess in a male contact when mated with the receptacle contact thereby to prevent withdrawal of the male contact from the male-contact-receiving passage in the receptacle contact by forces applied directly to the male contact and the receptacle contact.

With such a locking connector relative movement between the receptacle contact and the housing can be used to release the locking projection on the receptacle contact from the hole or recess in the male contact if the locking projection is positioned on the receptacle contact so as to be moved outwardly of the male-contact-receiving passage on increasing of the effective cross-sectional area of the male-contact-receiving passage of the receptacle contact.

Preferably the relative movement used to effect the release is in the opposite sense to that which occurs on mating of a male contact with the receptacle contact since then the release can be effected by a force applied to the housing in the direction of insertion of a male contact into the receptacle contact while a similar force applied to the receptacle contact only will not effect the release.

Two connectors according to the invention will now be described by way of example with reference to the drawings, in which.

Figure 1:
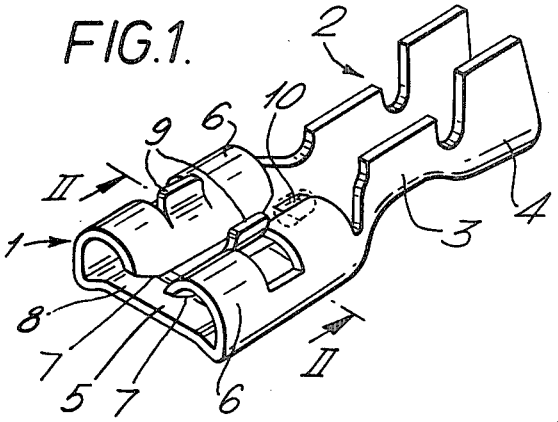
FIG. 1 is a perspective view of a receptacle contact for use in a first connector according to the invention.
Figure 2:
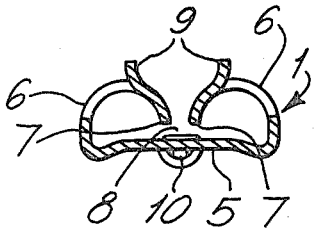
FIG. 2 is a section on the line II—II in FIG. 1.
Figure 3:
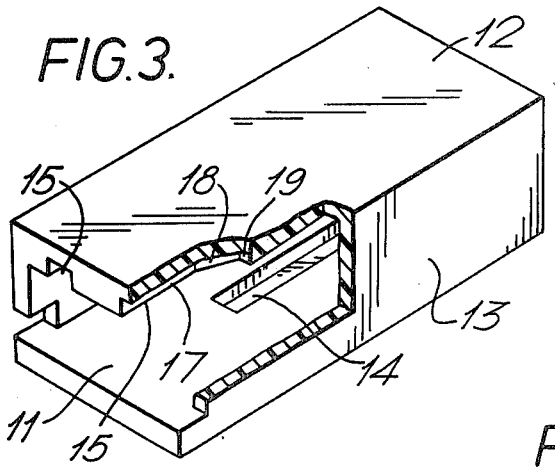
FIG. 3 is a perspective view, with part broken away, of a housing for use with the receptacle contact of FIGS. 1 and 2.
Figure 4:
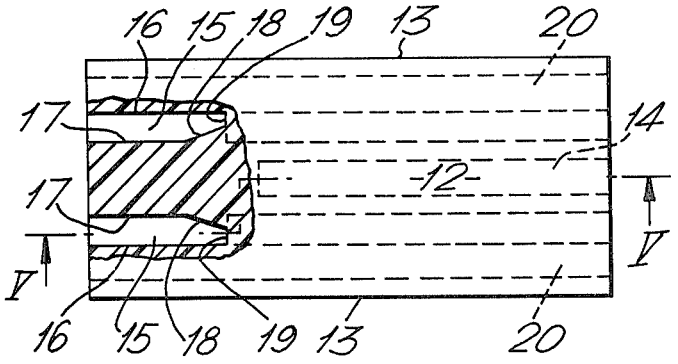
FIG. 4 is a plan view, with part broken away, of the housing of FIG. 3.
Figure 5:
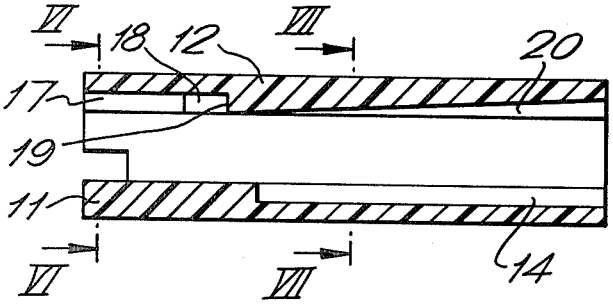
FIG. 5 is a section on the line V—V in FIG. 4.
Figure 6:
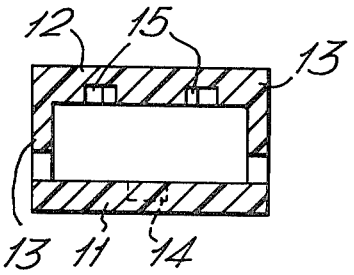
FIG. 6 is a section on the line VI—VI in FIG. 5.
Figure 7:
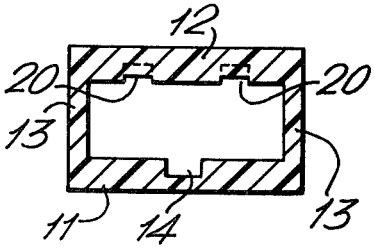
FIG. 7 is a section on the line VII—VII in FIG. 5.

The receptacle contact shown in FIGS. 1 and 2 is for mating with a flat tab male contact, and comprises a receptacle portion 1 and a wire-connection portion 2 integrally formed from sheet metal.

The wire-connection portion 2 comprises a first ferrule 3 for crimping about a bared end portion of the conductive core of an insulated wire (not shown), and a second ferrule 4 for crimping about the insulation of the wire, in known manner.

The receptacle portion 1 comprises a base 5 having edge portions 6 rolled in over the base 5 and having their free ends 7 directed towards the base 5.

The base 5 and edge portions 6, 7 of the receptacle portion 1 together define a male-contact-receiving passage 8 which will receive a flat tab male contact to be gripped between the base 5 and the edges 7 of the edge portions 6, in known manner.

A projection in the form of an ear 9 is struck from each of the edge portions 6 to extend away from the base 5.

A retention projection 10 is pushed out of the base 5 at the junction between the receptacle portion 1 and the wire connection portion 2.

In use of the receptacle contact shown in FIGS. 1 and 2 a flat tab male contact is inserted between the base 5 and the edges 7 of the edge portions 6, to be gripped therebetween due to the resilience of the receptacle portion 1. Such insertion acts to urge the edges 7 of the edge portions 6 away from the base 5, thus increasing the effective cross-sectional area of the passage 8 in the receptacle portion to admit the male contact. The force necessary for insertion of the male contact is thus dependent upon the contact force operative between the male contact and the receptacle contact when mated, and thus with known arrangements a desirable decrease in the necessary insertion force can be achieved only by decreasing the contact force, this not normally being desirable or possible.

The above described contact overcomes this problem by the provision of the projections 9. If the projections 9 are urged relatively away from each other transversely of the passage 8, then the edges 7 will be urged away from the base 5, thus increasing the effective cross-sectional area of the passage 8. If this is done prior to insertion of a male contact into the passage 8, then the male contact can be inserted with no, or at least a substantially reduced, resistance, whereafter release of the projections 9 will allow the edges 7 to grip the male contact with a high contact force.

The receptacle contact above described can therefore provide a given contact force with a considerably less insertion force being necessary than known receptacle contacts of similar construction.

Clearly the force necessary to urge the projections 9 apart can be provided by direct engagement with the user's fingers or by means of a suitable tool of the reversely-acting pliers type, but if the receptacle contact is to be contained in an insulating housing then it is convenient to use the housing to provide the necessary engagement with the projections 9.

Such a housing for use with the receptacle contact of FIGS. 1 and 2 will now be described with reference to FIGS. 3 to 7 also.

The housing is a one-piece moulding of electrically insulating plastics material, and is generally rectanguloid in shape, having a bottom wall 11, a top wall 12, and side walls 13, the housing being open at its axial ends.

An elongate recess 14 is formed in the inner surface of the bottom wall 11, the recess 14 being open to one, rearward end of the housing.

The top wall 12 is formed in its inner surface with two grooves 15 open to the other, forward end of the housing, the outer surfaces 16 of the grooves 15 extending parallel to the longitudinal axis of the housing, while the inner surfaces thereof have a first part 17 extending from the forward end of the housing parallel to the outer surfaces 16, and a second inner part 18 extending from the first part 17 towards the outer surface 16, the grooves 15 each terminating in a shoulder surface 19 facing the forward end of the housing. The top wall 12 decreases in thickness outwardly from the shoulder surfaces 19 towards the rearward end of the housing, over portions in line with the grooves 15, to form tapered grooves 20.

To form an electrical connector, the receptacle contact shown in FIGS. 1 and 2 is crimped in known manner to an insulated wire 21 (FIGS. 8 and 9) and is then inserted into the housing of FIGS. 3 to 7 from the rearward end thereof.

On such insertion the retention projection 10 of the receptacle contact is received in the recess 14 in the bottom wall 11 of the housing and limits forward movement of the receptacle contact relative to the housing by engagement with the closed inner end of the recess 14. The projections 9 of the receptacle contact are received in the grooves 20 in the top wall 12 of the housing, and are urged downwards towards the bottom wall 11 of the housing by engagement with the top wall 12 until they pass the shoulder surfaces 19 and are received in the grooves 15 in top wall 12.

Figure 8:
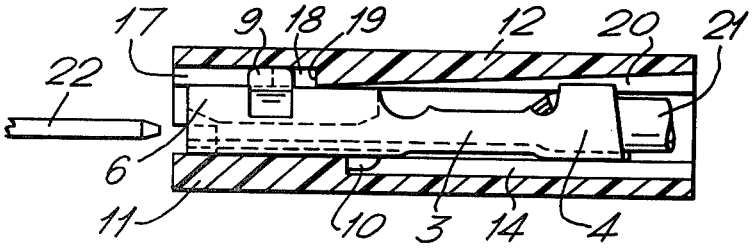
FIG. 8 is a vertical longitudinal sectional view through a connector formed from the receptacle contact of FIGS. 1 and 2 and the housing of FIGS. 3 to 7, together with a male contact for mating therewith.

The receptacle contact and housing then form a connector as shown in FIG. 8, with the receptacle contact secured in the housing but capable of axial movement relative thereto between end positions determined by engagement between the retention projection 10 and the end of the recess 14, and by engagement between the projections 9 and the shoulder surfaces 19, respectively.

A flat tab male contact 22 can then be mated with the receptacle contact to establish connection to the wire 21 connected to the receptacle contact.

Initially the receptacle contact is in a forward position, as shown in FIG. 8, relative to the housing.

As the male contact 22 is inserted into the passage 8 of the receptacle contact, its tapered leading end engages between the base 5 and the edges 7 of the edge portions 6, and meets a resistance to insertion which resistance must, as discussed above, be overcome by movement of the edges 7 away from the base.

Figure 9:
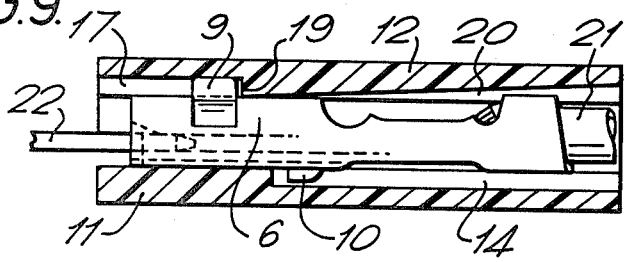
FIG. 9 is a view similar to FIG. 8 but showing the connector with the male contact being mated therewith.

This resistance causes the receptacle contact to move back relative to the housing as shown in FIG. 9, during which movement the projections 9 of the receptacle contact engage the surfaces 18 of the housing, this engagement, due to the diverging arrangement of the surfaces 18, causing the projections 9 to be urged away from each other. Such movement of the projections 9 causes the edges 7 to be moved away from the base 5, and thus increases the effective cross-sectional area of the passage 8 receiving the male contact 22. Rearward movement of the receptacle contact relative to the housing is limited, as discussed above, by engagement of the projections 9 with the shoulder surfaces 19 of the housing.

The engagement between the projections 9 of the receptacle contact and the surfaces 18 of the housing thus serves to assist the male contact 22 in moving the edges 7 away from the base 5, and the force necessary for insertion of the male contact 22 into the passage 8 is therefore less than would otherwise be required.

After insertion of the male contact 22 the resilience of the receptacle portion 1 causes the edges 7 to engage the male contact 22 which is thus gripped between the edges 7 and the base 5. On release of the housing, reaction forces between projections 9 and the surfaces 18 cause the housing to move rearwards on the receptacle until the retention projection 10 engages the closed end of the recess 14, the male contact 22 then being gripped with the full, necessary contact force.

Figure 10:
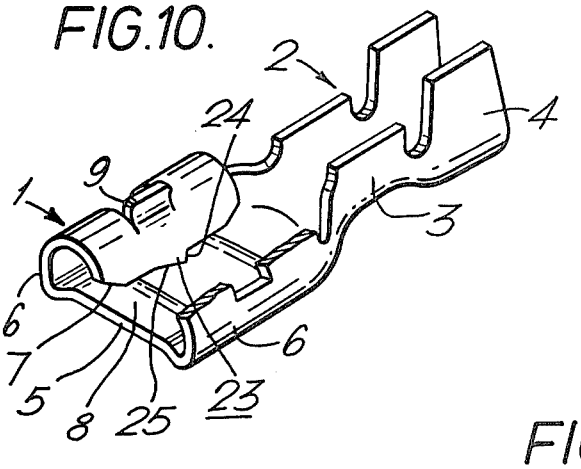
FIG. 10 is a perspective view of a receptacle contact for use in a second connector according to the invention.
Figure 11:
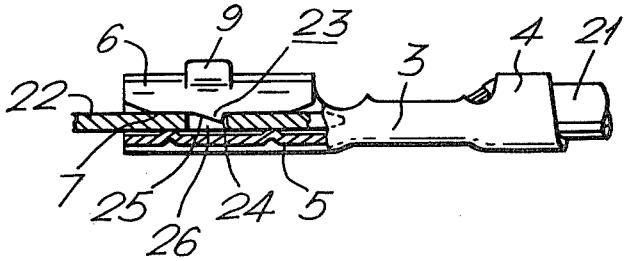
FIGS. 11 and 12 are views illustrating how the receptacle contact of FIG. 10 locks onto a complementary male contact.
Figure 12:
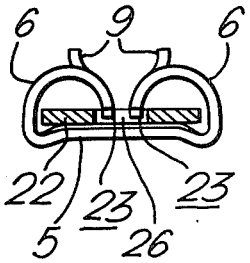

Referring now to FIGS. 10 to 12, the receptacle contact here shown is similar to that shown in FIGS. 1 and 2, and corresponding parts have the same references.

This receptacle contact does not however have a retention projection (10 in FIGS. 1 and 2), but the edges 7 of the edge portions 6 are each provided with a tang 23 projecting towards the base 5, and providing a shoulder surface 24 facing the wire connection portion 2, and a sloping forward facing surface 25.

This receptacle contact is for use with a flat tab male contact 22 having a hole 26 (or a recess) in its upper surface into which the tang 23 will extend when the male contact 22 is mated with the receptacle contact.

The male contact 22 thus becomes locked in the receptacle contact, withdrawal being restrained by engagement between the shoulder surface 24 of the tang 23 and the edge of the hole 26.

By urging the projections 9 apart the male contact 22 can be inserted with a low insertion force, as described above for the receptacle contact of FIGS. 1 and 2.

When it is required to release the male contact 22 from the receptacle contact the projections 9 are again urged apart, this moving the edges 7 of the edge portions 6 away from the base 5, and thus moving the tang 23 out of the hole 26 in the male contact 22, whereby the male contact 22 can be withdrawn from the receptacle contact.

Figure 13:
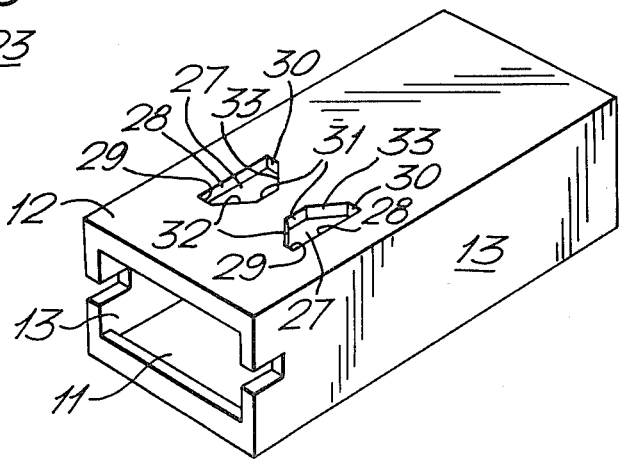
FIG. 13 is a perspective view of a housing for use with the receptacle contact of FIGS. 10 to 12.

Referring now to FIG. 13 also, this shows a housing for use with the receptacle contact of FIGS. 10 to 12 to form a connector providing for a low male contact insertion force, positive locking of the connector to a mated male contact, and easy release of the connector from a mated male contact when required.

The housing is moulded from electrically insulating plastics material, and is generally rectanguloid in shape having a bottom wall 11, top wall 12, and side walls 13. The axial ends of the housing are open.

The top wall 12 is formed with two aligned through holes 27 each having a straight outer surface 28 extending parallel to the longitudinal axis of the housing, a straight forward shoulder surface 29 and a straight rearward shoulder surface 30 extending at right-angles to the outer surface 28, and an inner surface having a straight central portion 31 extending parallel to the outer surface 28 and end portions 32 and 33 extending from the central portion 31 towards the outer surface 28 to meet the shoulder surfaces 29 and 30.

The relative sizes of the housing and the receptacle contact are such that when the receptacle contact is inserted into the housing from the rearward (right-hand) in FIG. 13) end of the housing the base 5 of the receptacle contact engages the bottom wall 11 of the housing and the projections 9 engage the top wall 12 of the housing such that the projections are urged downwards towards the base 5, resiliently deforming the edge portions 6.

When the receptacle contact is fully inserted into the housing the projections 9 reach the holes 27 and the resilience of the edge portions 6 urges the projections 9 into the holes 27.

The receptacle contact is then freely received in the housing but is secured therein so as to be capable of limited axial movement relative thereto, by engagement of the projections 9 with the shoulder surfaces 29 or 30 of the holes 27.

As described above for the connector of FIGS. 1 to 9, when a flat tab male contact 22 is mated with the connector the receptacle contact is urged backwards relative to the housing, and the projections 9 engage the surfaces 33 of the holes 27. The projections 9 are thus urged apart, thereby increasing the effective cross-sectional area of the male-contact-receiving passage 8 of the receptacle contact to allow insertion of the male contact 22 with a low insertion force.

The male contact 22 is inserted until the tangs 23 enter the hole 26 therein, as described above, to lock the connector to the male contact 22.

The connector is then such that axial forces applied to wires connected to the receptacle contact and/or the male contact 22 will not separate the connection.

When it is required to release the male contact 22 from the receptacle contact the housing is pulled backwards away from the male contact 22, and thus moves backwards relative to the male contact 22 and thus to the receptacle contact locked to the male contact 22. This movement causes the surfaces 32 of the holes 27 to engage the projections 9 and urge them apart, this, as described above, urging the edges 7 of the edge portions 6 away from the base 5 and thus lifting the tangs 23 out of the hole 26 in the male contact 22 which can then be withdrawn from the receptacle contact.

Although the connectors according to the invention, described above, are for mating with flat tab male contact, it will be appreciated that connectors according to the invention can be for mating with other types of male contact, for example circular cross-section pins.

Further, although in the connector described with reference to FIGS. 10 to 13, the holes 27 in the housing are open such that the projections 9 of the receptacle contact are accessible therethrough, it will be appreciated that these holes 27 can be covered if necessary or desirable, for example by means of a separate cover member or by not making the holes 27 through holes but merely recesses in the inner surface of the top wall 12 of the housing. To facilitate moulding of such a housing with recesses the housing can be split along one of the side walls 13 with the other side wall 13 serving as a hinge and the split side wall being provided with latching means to latch the housing about the receptacle contact. Such a housing would also facilitate insertion of the receptacle contact into the housing.

What is claimed is:

1. An electrical connector comprising a housing having an axial passage with camming means within the passage and a receptacle contact of the type having tab-receiving passage defined by a base and rolled-over edge portions, said edge portions being formed with outwardly directed projections engageable with said camming means, so that on movement of the receptacle contact relative to and within the housing, such engagement serving to urge the two projections away from each other thereby to effect an increase in the effective cross-sectional area of the tab-receiving passage of the receptacle contact, said housing being a one-piece moulding of electrically insulating plastics material, and is generally rectanguloid in shape, having a bottom wall, a top wall and side walls, the housing being open at its axial ends, said camming means including the top wall being formed in its inner surface with two spaced apart grooves defining opposing, laterally facing surfaces open to a forward end of the housing, the laterally facing surfaces having a first part extending rearwardly from the forward end of the housing parallel to the housing's side walls, and a second part extending obliquely towards the side walls, the laterally facing surfaces each terminating in a shoulder surface facing the forward end of the housing, the projections of the receptacle contact being received against the laterally facing surfaces in the top wall of the housing.

2. A connector as claimed in claim 1, in which the top wall decreases in thickness outwardly from the shoulder surfaces towards the opposite rearward end of the housing, over portions in line with the grooves, to form tapered grooves.

3. An electrical connector, comprising:

a. an insulating housing having an axial passage adapted to receive a receptacle contact therein, means in the axial passage to permit limited axial movement of a receptacle contact positioned therein, and further, camming means located in the upper wall defining one surface of the axial passage; and b. a receptacle contact, positioned in the axial passage, and having a base with the edge portions rolled in thereover with the free ends spaced from and directed in towards the base, said base and edge portions together defining a tab-receiving passage, further, each of the edge portions having an upwardly directed projection thereon, said projections engaging said camming means so that upon rearward axial movement of the receptacle contact in the axial passage, the projections are cammed laterally, thereby raising the free ends of the edge portions away from the base causing an increase in the space between the free ends and base.

4. A connector as claimed in claim 3, in which the receptacle contact is formed with a locking projection arranged to engage in a hole or a recess in a tab when mated with the receptacle contact thereby to prevent withdrawal of the tab from the tab-receiving passage in the receptacle contact by forces applied directly to the tab and the receptacle contact.

5. A connector as claimed in claim 4, in which the locking projection is positioned on the receptacle contact so as to be moved outwardly of the tab receiving passage on increasing of the effective cross-sectional area of the tab-receiving passage of the receptacle contact, whereby relative movement between the receptacle contact and the housing can be used to release the locking projection on the receptacle contact from the hole or recess in the tab.

6. A connector as claimed in claim 5, in which the relative movement used to effect the release is in the opposite sense to that which occurs on mating of a tab with the receptacle contact whereby the release can be effected by a force applied to the housing in the direction of insertion of a tab into the receptacle contact while a similar force applied to the receptacle contact only will not effect the release.

7. A connector as claimed in claim 6, in which there are two locking projections each in the form of a tang projecting from an individual one of the edges of the edge portions, each tang providing a shoulder surface facing away from the mating end of the receptacle contact, and a sloping oppositely facing surface.

8. An electrical connector comprising, a housing molded from electrically insulating plastics material, and is generally rectanguloid in shape having a bottom wall, a top wall and side walls, the ends of the housing being open, the top wall being formed with two spaced apart aligned holes each being defined by a straight outer wall adjacent to the respective housing's side wall and extending parallel to the longitudinal axis of the housing, forwardly and rearwardly facing walls extending at right angles to the outer wall and an inner wall having a straight center portion extending parallel to the outer wall and end portions extending obliquely from the center portion towards the outer wall to meet the forwardly and rearwardly facing walls, and a receptacle contact having a tab-receiving passage formed by a base and turned-in edge portions with projections extending upwardly from the edge portions, said contact being positioned in the housing with the projections being received in the holes in the top wall of the housing, the receptacle contact thereby being secured in the housing so as to be capable of limited axial movement relative thereto by engagement of the projections with the forwardly and rearwardly facing walls of the holes in the top wall of the housing.

9. A connector as claimed in claim 8, in which the holes in the top wall of the housing are through holes.

10. An electrical receptacle contact having a receptacle portion comprising, a base having edge portions rolled in over the base with their free ends directed back towards the base, the base and edge portions together defining a tab-receiving passage which will receive a flat tab male contact to be gripped between the base and the free ends of the edge portions, further, said receptacle portion having a projection struck from on or near the crest on each of the rolled in edge portions and extending away from the base, relative movement of the projections away from each other transversely of the tab-receiving passage resulting in an increase in the effective cross-sectional area of the tab-receiving passage by the free ends being lifted away from the base.

11. A contact as claimed in claim 10, including a locking projection projecting from the free ends of each edge portion towards the base, each locking projection providing a shoulder surface facing away from the mating end of the contact, and an oppositely facing surface sloping from the shoulder surface away from the base.

12. A housing for an electrical contact, the housing being a one-piece moulding of electrically insulating plastics material, and being generally rectanguloid in shape, having a bottom wall, a top wall, and side walls, the housing being open at its axial end, in which the top wall is formed with two aligned holes each having a straight outer surface extending parallel to the longitudinal axis of the housing, a straight forward shoulder surface and a straight rearward shoulder surface extending at right-angles to the outer surface, and an inner surface having a straight central portion extending parallel to the outer surface and end portions extending from the central portion towards the outer surface to meet the shoulder surfaces.

13. A housing as claimed in claim 12, in which the holes in the top wall are through holes.

14. In an electrical connector where a receptacle contact is movably positioned in an axial passage of an insulating housing, said contact being of the type having a receptacle portion defined by a base with its edge portions rolled in over the base so that the free ends of the edge are directed towards the base, said base and free ends being adapted to receive and grip a tab contact therebetween, the improvement comprising:

a. projections on the edge portions extending upwardly therefrom; and b. camming means on the upper wall of the axial passage for receiving and camming the projections laterally to raise the free ends away from the base upon the receptacle contact being moved rearwardly in the axial passage.

15. The connector of claim 14 in which the camming means include two spaced-apart grooves defining opposing, laterally facing surfaces open to the forward end of the housing, the laterally facing surfaces having a first part extending rearwardly from the forward end of the housing parallel to the housing's side walls, and a second part extending obliquely towards the side walls, the laterally facing surfaces each terminating in a shoulder surface facing the forward end of the housing, said projections being received against the laterally facing surfaces of said grooves.

* * * * *

UNITED STATES PATENT OFFICE

CERTIFICATE OF CORRECTION

Patent No. 4,220,388 Dated September 2, 1980

Inventor(s) HELEN DECHELETTE

It is certified that error appears in the above-identified patent and that said Letters Patent are hereby corrected as shown below:

On title page after "Inventor", please add

- - - Assignee: AMP Incorporated, Harrisburg, PA - - - .

Signed and Sealed this

*Twentieth* Day of *January 1981*

[SEAL]

*Attest:*

RENE D. TEGTMEYER

*Attesting Officer*

*Acting Commissioner of Patents and Trademarks*